United States Patent [19]

Chandley et al.

[11] Patent Number: 4,606,396

[45] Date of Patent: Aug. 19, 1986

[54] SAND MOLD AND APPARATUS FOR REDUCED PRESSURE CASTING

[75] Inventors: George D. Chandley; Richard L. Sharkey, both of Amherst, N.H.

[73] Assignee: Hitchiner Manufacturing Co., Inc., Milford, N.H.

[21] Appl. No.: 574,938

[22] Filed: Jan. 27, 1984

Related U.S. Application Data

[60] Continuation of Ser. No. 368,671, Apr. 15, 1982, abandoned, which is a division of Ser. No. 154,230, May 29, 1980, Pat. No. 4,340,108, which is a continuation-in-part of Ser. No. 75,169, Sep. 12, 1979, abandoned, which is a continuation-in-part of Ser. No. 947,621, Oct. 2, 1978, abandoned.

[51] Int. Cl.[4] ..... B22C 9/02; B22C 9/08; B22D 18/06

[52] U.S. Cl. ..... 164/255; 164/350; 164/360; 164/361; 164/363

[58] Field of Search ..... 164/363, 361, 350, 360, 164/63, 65, 133, 255

[56] References Cited

U.S. PATENT DOCUMENTS

| | | | |
|---|---|---|---|
| 1,291,390 | 1/1919 | Broadbent | 164/350 |
| 1,591,094 | 7/1926 | Mantei | 164/254 |
| 1,653,232 | 12/1927 | Smith | 164/350 |
| 2,476,296 | 7/1949 | Hardy | 164/360 X |
| 2,908,054 | 10/1959 | Wilkins | 164/255 |
| 2,923,040 | 2/1960 | Goodwin et al. | 164/63 |
| 3,628,598 | 12/1971 | MacNeill et al. | 164/350 |
| 3,863,706 | 2/1975 | Chandley et al. | 164/255 |
| 3,900,064 | 8/1975 | Chandley et al. | 164/363 X |
| 4,112,997 | 9/1978 | Chandley et al. | 164/350 X |

FOREIGN PATENT DOCUMENTS

| | | | |
|---|---|---|---|
| 785837 | 11/1957 | United Kingdom | 164/63 |

*Primary Examiner*—Nicholas P. Godici
*Assistant Examiner*—J. Reed Batten, Jr.

[57] ABSTRACT

Casting metal in rigid, self supporting, gas permeable molds with one or more mold cavities for molding one or more parts, in which the mold cavities have gate passages with their lower open ends at the lower surface of the mold, by submerging the lower ends of the gate passages beneath the surface of molten metal and applying a reduced pressure to the upper surface of the mold to fill the mold cavities with molten metal to produce unconnected metal parts or groups of parts.

13 Claims, 10 Drawing Figures

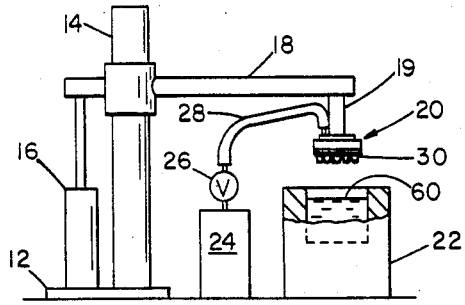
FIG 1
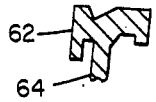
FIG 6
FIG 3
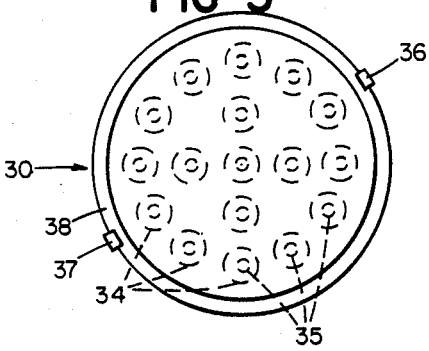
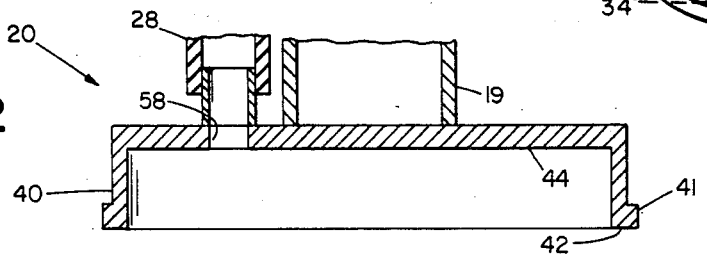
FIG 2
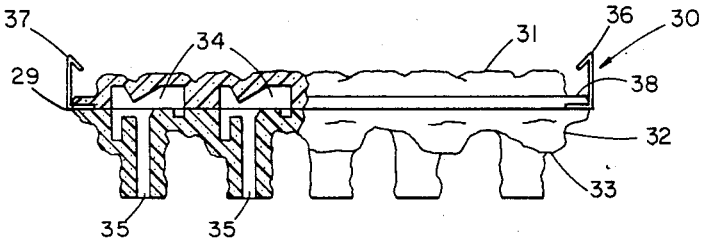
FIG 4
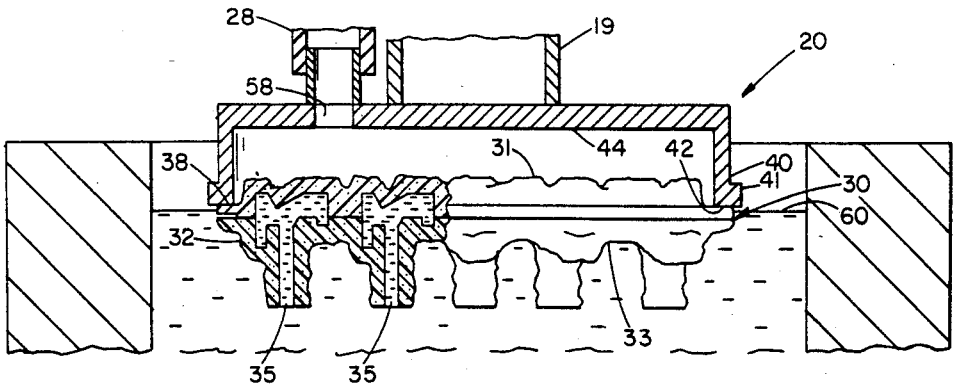
FIG 5

FIG 7
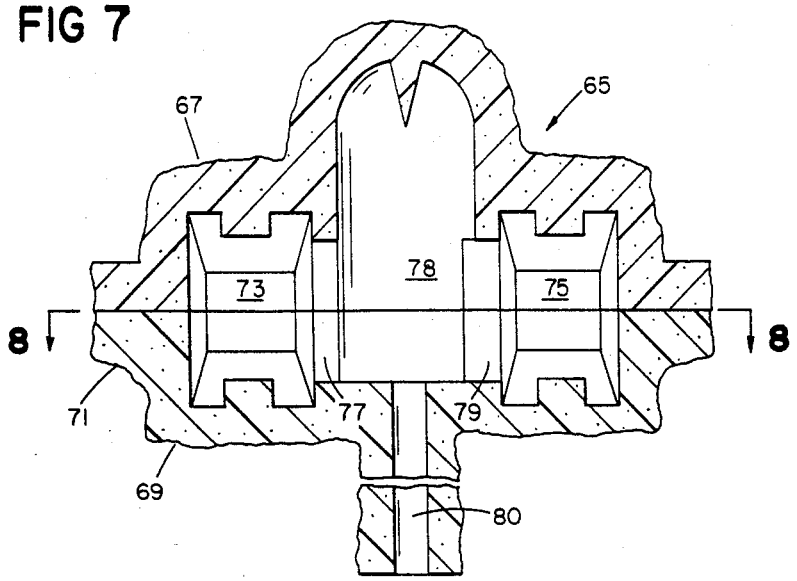
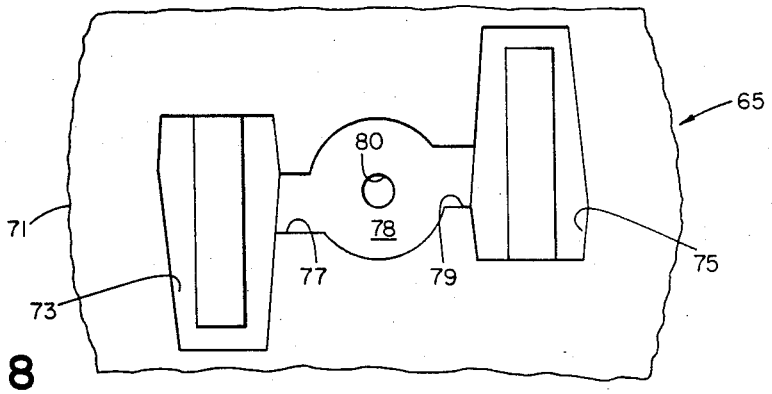
FIG 8
FIG 9
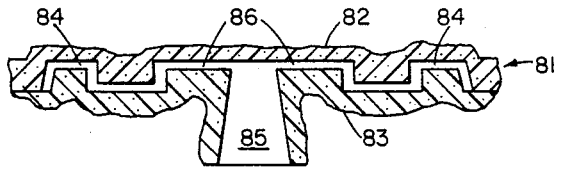
FIG 10
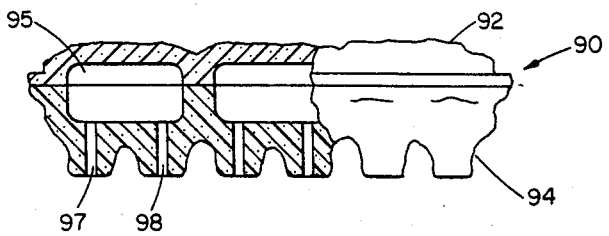

SAND MOLD AND APPARATUS FOR REDUCED PRESSURE CASTING

This is a continuation of application Ser. No. 368,671, filed Apr. 15, 1982 (now abandoned), which was a division of application Ser. No. 154,230, filed May 29, 1980 now U.S. Pat. No. 4,340,108, issued July 20, 1982, which was a continuation-in-part of Ser. No. 75,169, filed Sept. 12, 1979 (now abandoned), which was a continuation-in-part of Ser. No. 947,621, filed Oct. 2, 1978 (now abandoned).

Although the techniques disclosed in U.S. Pat. Nos. 3,863,706 and 3,900,064 have been in successful commercial use for several years, we have discovered the existence of certain problems in their use with gas permeable molds of the low temperature bonded sand grain type rather than the high temperature resistant ceramic type with which they were primarily intended to be used.

These problems occur because low temperature bonded sand grain shell molds, in which sand grains or similar particles are bonded together with a small proportion of an inorganic or organic plastic thermal or chemical setting resin or equivalent material, although much less expensive to produce than ceramic molds, have two major deficiencies as compared to ceramic molds, in that they have relatively soft interior mold cavity surfaces and also fail rapidly at high temperatures because their low temperature bonding materials decompose at low temperatures so that the mold fails rapidly at temperatures lower than that of the molten casting metal, particularly with ferrous metals.

Insofar as the first deficiency is concerned, under the high vacuum required with the techniques of those patents in order to lift the molten metal up the single long vertical central riser from which it flows into the multiple mold cavities through vertically spaced gate passages, the molten metal frequently penetrates the soft mold surface of a low temperature bonded sand grain mold to the extent that casting quality is so reduced as to be unacceptable.

Insofar as the second deficiency is concerned, since the effective life before failure of a low temperature bonded sand grain mold is measured in seconds in the presence of molten ferrous metals, the time required to solidify the castings in the molds of those patents is frequently of such duration that the low temperature bonded sand grain mold fails before the molten metal in the mold cavities is sufficiently solidified.

Because of these problems, under many circumstances, particularly when casting parts of ferrous metals, low temperature bonded sand grain molds cannot be utilized with the techniques of those patents, so that the much more expensive ceramic shell molds must be substituted in order to provide acceptable castings.

Accordingly, it is a major object of the present invention to provide novel rigid, self supporting, gas permeable, low temperature bonded, sand grain molds and methods and apparatus for use in conjunction therewith, operable within relatively short time cycles and at relatively low vacuum, to facilitate metal casting in such molds.

It is another object of the invention to provide for automatic separation of the cast metal parts or groups of parts from one another.

It is still another object of the invention to provide novel relatively simple and inexpensive, rigid, self supporting, multiple cavity, gas permeable, low temperature bonded, sand grain molds and methods and apparatus for use in conjunction therewith for the more economical casting of metal parts.

According to a particularly important aspect of the present invention, we have discovered that by using a rigid, self supporting, low temperature bonded, sand grain mold having one or more mold cavities with gate passages or portions thereof that have a maximum width or diameter of 0.75 inches and preferably less than 0.50 inches, after the mold cavities have been filled with molten metal by applying reduced pressure to the top surface of a mold whose bottom surface is submerged in molten metal, since the molds are unheated and are at ambient room temperature, the thin sections of molten metal in the relatively narrow gate passage portions quickly solidify, but only for a short period of time before they remelt due to the heat provided by the underlying molten metal in the container.

We have discovered that this brief period of gate passage solidification makes it possible quickly to move the mold vertically upwardly out of contact with the underlying surface of molten metal, even though the molten metal in the mold cavities may not yet have entirely solidified, before the solidified metal in the narrow gate passage portions remelts and allows the molten metal in the mold cavities to drain back into the container. Particularly with high melting point metals, such as ferrous metals cast at temperatures of 2000 degrees F. or higher, we have found that by quickly moving the mold out of contact with the underlying surface of molten metal, after the initial occurrence of solidification of metal in the narrow gate passage portions, further heat input into the mold is prevented and mold failure time is extended sufficiently for the castings in the mold cavities to solidify if they have not already done so. It also makes possible an unusually short casting cycle time, which reduces production cost.

With molds having relatively small cavities, such as those having internal thicknesses of less than 0.50 inches, we have found that filling and solidification of the molten metal both in the mold cavity and the adjacent narrow gate passage or portion thereof will occur rapidly enough so that the mold may be filled and the metal solidified before the mold fails. With larger mold cavities, at least in cases in which harmful shrinkage does not occur upon solidification, more than a single narrow gate passage may be used for more rapid mold cavity filling so that the mold may be filled and the metal solidified before the mold fails.

With metals which shrink upon solidification and with large mold cavities, such as those having internal thicknesses of greater than 0.50 inches, which cannot be filled through the narrow gate passage portions of the mold before mold failure occurs, a blind riser may be used between one or more vertical gate passages and a mold cavity, so that at least a portion of the metal in the blind riser and in the mold cavity will remain in molten condition for flow into the mold cavity after removing the mold from contact with the underlying surface of molten metal.

When using multiple cavity molds according to our invention, since the lower open ends of the gate passages are spaced from one another, a plurality of unconnected cast metal parts or groups of parts are automatically provided.

With the conventional rigid, self supporting, low temperature bonded, sand grain mold as used in the methods of the present invention, we have discovered that the maximum permissible submergence times, that is, the maximum length of time that the mold may remain in contact with the underlying surface of molten metal before the solidified metal in the narrow portions of the gate passages remelts or the mold begins to fail, is largely determined by the temperature at which the underlying molten metal must be maintained.

In the case of ferrous metals, such as cast iron and steel, which are cast at temperatures greater than 2000 degrees F., the time is relatively short, a maximum of about 30 seconds; so that submergence times of no more than about 5 to 20 seconds have been found to be desirable. Also, in order to prevent mold cavity surface penetration, reduced pressures of only about −1.0 to −3.0 psig (13.7 to 11.7 psia) should be used to raise the molten ferrous metal into mold cavities to a level no higher than about 6 to 8 inches above the surface of the molten metal in the container. With lower melting point metals, such as copper and aluminum and their alloys, longer times and higher mold cavity heights may be used.

The novel rigid, self supporting, gas permeable, low temperature bonded, sand grain mold of our invention has side surfaces extending between vertically spaced upper and lower surfaces. One or more mold cavities, each for molding one or more parts, may extend to or across the mold parting plane and are spaced between the upper and lower surfaces, such mold cavities being arranged in a generally horizontal plane, preferably distributed both lengthwise and widthwise thereof, and horizontally spaced from one another. Each mold cavity has at least one individual gate passage or portion thereof having a maximum width or diameter of less than 0.75 and preferably no more than about 0.5 inches, with the lower open end of each gate passage having a vertical portion terminating at the lower surface of the mold. With multiple cavity molds, the vertical portions of the gate passages are generally perpendicular to the parting plane and their open ends are spaced from one another and distributed in a horizontal plane.

For castings having wall thicknesses of less than about 0.50 inch, the narrow gate passage portions may be adjacent the mold cavity, with a larger central vertical gate passage. For larger castings having greater wall thicknesses, more than one narrow gate passage portion may be used if shrinkage is not a problem; otherwise, a blind riser may be interposed between one or more gate passages having a narrow vertical portion and one or more part cavities.

For utilizing the rigid, self supporting, gas permeable, low temperature bonded, sand grain mold of the invention, the apparatus and methods thereof include, in addition to a container for holding molten metal, a chamber having a bottom opening with a peripheral outer wall for sealing against an upper peripheral surface of the mold with the side and bottom surfaces of the mold extending downwardly therebeyond. Power means are provided for supporting the chamber for relative movement toward and away from the container to lower the lower open ends of the gate passages and the lower mold surface beneath the surface of molten metal in the container. Vacuum means are provided for applying a reduced pressure to the upper surface of the mold within the chamber for simultaneously filling the mold cavities after lowering the chamber to submerge the lower surface of the mold and the open ends of the gate passages beneath the underlying surface of molten metal.

Our invention has thus made possible the production of high quality castings, particularly of ferrous metals, utilizing greatly simplified and highly economical techniques, resulting in a substantial decrease in production costs.

For the purpose of more fully explaining the above and further objects and features of our invention, reference is now made to the following detailed description of preferred embodiments thereof, taken together with the accompanying drawings, wherein:

FIG. 1 is a diagrammatic side view, partly in section, of a mold and apparatus according to the invention for carrying out the methods thereof;

FIG. 2 is a detail side cross-sectional view of the chamber portion of the apparatus of FIG. 1;

FIG. 3 is a top view of the mold of FIG. 1;

FIG. 4 is a detail side partial cross-sectional view of the mold of FIG. 3;

FIG. 5 is a detail side partial cross-sectional view of the mold of FIGS. 3 and 4 mounted on the chamber of the apparatus, with the lower surface of the mold submerged beneath the underlying surface of molten metal in the container;

FIG. 6 is a cross-sectional side view of a metal part molded according to the invention;

FIG. 7 is a detail side partial cross-sectional view of a modification of the mold of FIG. 1;

FIG. 8 is a detail top partial cross-sectional view of the mold of FIG. 7, taken along line 8—8 of FIG. 7;

FIG. 9 is a detail side partial cross-sectional view of another modification of the mold of FIG. 1; and FIG. 10 is a detail side partial cross-sectional view of a further modification of the mold of FIG. 1.

Referring to FIG. 1, the apparatus of the invention, in general, includes a base 12 having mounted thereon a post 14 on which is mounted, for vertical sliding movement by power piston and cylinder 16, a horizontally extending arm 18. Chamber 20, hereinafter more fully described, is mounted on support member 19 which extends downwardly from the free end of arm 18 above a container 22 for holding molten metal.

Referring to FIGS. 3 and 4, the rigid, self supporting, gas permeable, low temperature bonded, sand grain mold of the present invention, generally designated 30, is made by techniques and equipment well known in the art, of sand grains or equivalent particles and inorganic or organic thermal or chemical setting plastic or equivalent low temperature bonding material, with a minor percentage, usually about 5%, of the low temperature bonding material, by distributing the loose sand and bonding material mixture over metallic half patterns on a metal base plate which forms the parting plane, over which the mixture hardens into a rigid, self supporting mold half shell which is then removed from the metallic half patterns and base plate for use.

As shown in FIG. 4, the mold 30 is constructed of two such half shells, upper and lower, which are then adhesively secured together along horizontal mold parting plane 29 to provide a unitary, disposable, rigid, self supporting mold 30. Mold 30 has peripherally extending side surfaces 32 extending vertically between vertically spaced upper surface 31 and lower surface 33 which are generally parallel to mold parting plane 29. Surfaces 31 and 33 are irregular and have a rough outer surface since they were formed of generally uniform thickness on the irregular contour of the pattern.

For supporting mold 30 on chamber 20, a pair of opposed, upwardly extending metal spring clips 36 and 37 having inwardly and downwardly turned upper ends are mounted with their lower horizontal ends within parting plane 29. Preferably, spring clips 36 and 37 are of a material which either melts or is destroyed at a temperature lower than that of the metal to be cast.

To provide for the application of reduced pressure to the upper surface 31 of mold 30, said upper surface is formed at its outer edge, as by pressing it while still in plastic condition, to form a continuous peripheral horizontal flat sealing surface portion 38 suitable for sealing against chamber 20, as hereinafter more fully explained.

A plurality of single part mold cavities are provided spaced between the upper and lower surfaces of mold 30, extending across mold parting plane 29, as shown in FIGS. 3 and 4, of which two are shown in FIG. 4. Multiple part cavities may also be so provided, as explained in more detail hereinafter. In commercial practice, the number of such mold cavities would generally fall between six and twenty, seventeen being shown in FIG. 3. Such single or multiple part mold cavities are distributed within the horizontal area within the periphery of mold 30, with a plurality thereof extending across the length and width of mold 30 between its upper and lower surface 31 and 33. Cavities 34 are horizontally spaced from one another generally in a horizontal plane and extend across parting plane 29. Each mold cavity, such as is shown in connection with cavities 34, has an individual vertical gate passage 35, generally perpendicular to parting plane 29, extending from its lower side, with the lower open ends of such vertical gate passages 35 being spaced from one another both widthwise and lengthwise and terminating in a generally horizontal plane parallel to parting plane 29 at the lower surface 33 of mold 30.

As explained above, at least a portion of each of gate passages 35 must be relatively narrow in at least one dimension, at most not greater than 0.75 inch, and preferably not more than 0.5 inch, in order to function according to our invention. Conveniently, these narrow gate passages or portions thereof are vertical and of circular cross section, although other configurations may be used.

Referring to FIGS. 1, 2 and 5, chamber 20 provides the support for holding mold 30 against chamber 20 and for applying reduced pressure from vacuum pump 24 through a suitable valve 26 and hose 28 to its upper surface 31. As seen in FIG. 2, chamber upper wall 44 is connected to the lower end of support 19 and is provided with an access port 58 to which vacuum hose 28 is connected for applying a reduced pressure to the interior of chamber 20 and to the upper surface 31 of mold 30 when desired.

In addition, chamber 20 has a bottom opening defined by its downwardly extending peripheral outer wall 40 which extends downwardly from the outer periphery of its upper wall 44 to define the interior of chamber 20. As best seen in FIGS. 2, 4 and 5, outer wall 40 may be provided about its lower end with a horizontal sealing surface 42 for sealing against the horizontal upper sealing surface 38 of mold 30 around the periphery thereof and generally coextensive with the horizontal area of mold 30 containing the mold cavities, with a portion of the peripheral side surface 32 and bottom surface 33 of mold 30 extending downwardly beyond chamber 20.

For supporting mold 30 against chamber 20 prior to the application of reduced pressure, chamber 20 is provided around its lower end with a peripheral abutment 41, the upper surface of which cooperates with the upper ends of spring clips 36 and 37 to support mold 30 with its sealing surface 38 in contact with sealing surface 42 of chamber 20.

In operation, with chamber 20 in raised position as shown in FIG. 1, mold 30 is manually or automatically positioned with its peripheral sealing surface 38 against sealing surface 42 of chamber 20 and with clips 36 and 37 engaging abutment 41.

Power piston and cylinder 16 are then operated to move chamber 20 carrying mold 30 therebeneath downwardly toward container 22 to lower the lower surface 33 of mold 30 with the lower open ends of all of the vertical gate passages beneath the surface 60 of molten metal in container 22.

Valve 26 is then operated to apply over enclosed upper surface 31 of mold 30, a reduced pressure, preferably only of about −1.0 to −3.0 psig (13.7 to 11.7 psia), through chamber port 58 to the interior of chamber 20 and the upper surface 31 of mold 30 within the periphery of sealing surface 38 and coextensive with the mold area containing the mold cavities. The reduced pressure applied to the upper surface 31 of mold 30 causes molten metal to rise into the gate passages and fill all the mold cavities simultaneously. The molten metal also destroys clips 36 and 37.

In accordance with the methods of our invention as explained in detail above, the power piston and cylinder 16 are operated shortly after submergence, as soon as the mold cavities have been filled and molten metal extending across at least a portion of each of the gate passages has solidified, to raise chamber 20 and mold 30, whereupon a portion of molten metal remaining in the gate passages adjacent their lower ends below the solidified portion drains back into container 22, leaving unconnected metal parts, such as shown in FIG. 6, in mold 30. While chamber 20 and mold 30 are being raised, the reduced pressure provides the sole support of mold 30.

After chamber 20 has been raised to its inoperative position, as shown in FIG. 1, valve 26 may be operated to disconnect the vacuum pump 24 and to release mold 30 so that a new mold can be substituted.

The unconnected metal parts 62, with a short portion of gate passage metal 64 connected to them, as shown in FIG. 6, may then be separated from the decomposed mold 30 in the usual manner.

It is also contemplated that clips 36 and 37 may be omitted and valve 26 may be operated initially to provide the sole force to hold mold 30 in operating position against chamber 20.

In FIGS. 7 through 10 are shown molds having multi-part cavities and multiple vertical gate passages.

Thus, in FIGS. 7 and 8 is shown a portion of a multi-cavity mold, generally designated 65 and constructed as explained above, having, spaced between its upper surface 67 and its lower surface 69 and inwardly of its peripheral side surface 71, a plurality of multi-part mold cavities, of which one is shown in FIGS. 7 and 8.

Each multi-part mold cavity includes two part cavities 73 and 75 having horizontal riser ingate passages 77 and 79, respectively, both connected to a central blind riser 78, which is in turn connected to a narrow vertical gate passage 80. The shape, quantity and size of the riser ingate passages 77 and 79 and of blind riser 78 may be varied to suit the particular casting shape and size. The transverse dimension of vertical gate passage 80 is about 0.25 to 0.50 inches in diameter, in accordance with the teachings of the methods of the present invention. More than one such vertical gate passage may be needed in certain circumstances.

Molds of the type illustrated in FIGS. 7 and 8 are particularly useful when large parts, having part cavity dimensions in excess of 0.50 inches, for example, are to be molded, since otherwise there may be insufficient time available to completely solidify the molten metal in the mold part cavities before mold failure occurs, particularly with ferrous metals. Also, with metals which shrink upon solidification, the blind riser acts as a source of supply of molten metal during solidification of the metal in the part cavities.

In operation, mold 65 is filled as described above and the mold removed from contact with the molten metal in the container as soon as molten metal has filled mold cavities 73 and 75 and blind riser 78 and has solidified in vertical gate passage 80. However, the metal in blind riser 78 remains molten for a sufficient period of time after the removal of mold 65 from contact with the molten metal in the container to continue to feed mold cavities 73 and 75 through their riser ingate passages 77 and 79 to compensate for shrinkage during solidification of the metal in the mold cavities 73 and 75. This arrangement allows the mold cycle time to be reduced so that premature mold failure is avoided. After solidification is complete, unconnected groups of metal parts, including their connecting riser ingates and portions of the blind riser and the vertical gate, remain in the decomposed mold 65.

In FIG. 9 is shown a multi-cavity mold 81 having, between its upper surface 82 and lower surface 83, a plurality of mold cavities 84, of which two are shown in FIG. 9, clustered around a central vertical gate passage 85 having narrow horizontal gate passage portions 86 according to the invention connecting the mold cavities 84 to vertical gate passage 85. This arrangement is satisfactory for casting parts having thicknesses of no more than about 0.5 inch, since solidification will immediately occur both in the mold cavities 84 and the narrow gate passage portions 86, with the molten metal draining from vertical gate passage 85 upon removal of mold 81 from contact with the underlying surface of molten metal to provide unconnected cast parts.

In FIG. 10 is shown a multi-cavity mold 90 having, between its upper surface 92 and its lower surface 94, a plurality of mold cavities 95, each having two vertical gate passages 97 and 98, for more rapid filling of the relatively large mold cavities 95 through narrow vertical gate passages in accordance with our invention in order to fill the mold cavities and remove the mold as soon as the metal in the vertical gate passages solidifies and before mold failure occurs. This type of mold is particularly useful when casting metals in which shrinkage compensation is not required, in molds having large part cavities which cannot be filled through a single narrow vertical gate passage before mold failure occurs.

Further embodiments of the methods, molds and apparatus of our invention, within the spirit thereof and the scope of the appended claims, will be apparent to those skilled in the art of metal casting.

What is claimed is:

1. Casting apparatus including a container for holding molten metal to provide a molten metal surface in a generally horizontal plane a mold support including a chamber positioned above the surface of molten metal in said container, said chamber having a downwardly extending side wall and a peripheral sealing surface a rigid, self supporting, gas permeable, low temperature bonded sand grain mold having side surfaces extending between vertically spaced upper and lower surfaces, a peripheral sealing surface, and mold cavity means spaced between said upper and lower surfaces, said mold cavity means having gate passage means extending downwardly therefrom, said gate passage means having its lower open end terminating at the lower surface of said mold said mold being supported from above by said mold support with their peripheral sealing surfaces in peripheral contact, with at least a substantial portion of said mold side surfaces and the entire lower surface of said mold extending downwardly beyond said chamber side wall power means supporting said mold support for relative movement to move the entire lower surface of said mold including the open end of said gate passage means beneath the surface of molten metal in said container with said mold support side wall spaced thereabove, and vacuum means for relatively varying the pressure within said chamber and said mold to fill said mold after lowering said entire lower surface of said mold beneath the surface of molten metal in said container with said mold support side wall spaced thereabove wherein said mold further comprises upper and lower low temperature bonded mold halves adhesively secured together in a general horizontal mold parting plane with said upper and lower surfaces generally parallel to and vertically spaced on opposite sides of said mold parting plane said mold cavity means extending to said generally horizontal mold parting plane and spaced between said upper and lower surfaces, and said gate passage means extending vertically from said mold cavity means through said lower mold half to said lower mold half lower surface and terminating with its lover open end exposed at said lower surface, said gate passage means having a restricted portion having a maximum width in at least one dimension of 0.75 inches.

2. Casting apparatus as claimed in claim 1, wherein said mold further comprises a plurality of gate passages extending vertically from said mold cavity means through said lower half and terminating in a generally horizontal plane with their lower open ends spaced from one another exposed at said lower surface, said gate passages each having restricted portions having a maximum width in at least one dimensions of 0.75 inches, and said mold halves having a maximum life before failure of less than about thirty seconds in the presence of molten metal at a temperature of greater than 2000 degrees F.

3. Casting apparatus as claimed in claims 1, or 2, wherein said mold cavity means includes at least two gate passages extending vertically from said one mold cavity through said lower mold half.

4. Casting apparatus as claimed in claims 1 or 2, wherein said mold cavity means includes a plurality of mold cavities horizontally spaced from one another, and said gate passages includes at least one gate passage extending vertically from each mold cavity through said lower mold half.

5. A unitary, rigid, self supporting, gas permeable, low temperature bonded, sand grain mold having peripheral side surfaces extending between vertically spaced upper and lower surfaces with mold cavity means spaced therebetween and vertical gate passage means with its lower open end exposed at said lower surface, for use in a method of vacuum casting metal comprising:

submerging said lower surface and said open end of said gate passage means beneath an underlying surface of molten metal while maintaining said upper surface and at least a portion of said side surfaces thereabove;

applying a reduced pressure to the upper surface of said mold to simultaneously fill said gate passage means and said mold cavity means with molten metal;

solidifying said molten metal throughout the transverse dimension of at least a portion of said gate passage means; and thereafter removing said mold and the submerged open end of said gate passage means from contact with said underlying surface of molten metal before said solidified metal in said gate passage means portion remelts due to contact with said underlying surface of molten metal, said mold comprising upper and lower low temperature bonded mold halves adhesively secured together in a generally horizontal mold parting plane with said upper and lower surfaces generally parallel to and vertically spaced on opposite sides of said mold parting plane mold cavity means extending to said generally horizontal mold parting plane and spaced between said upper and lower surfaces, and gate passage means extending vertically from said mold cavity means through said lower mold half to said lower mold half lower surface and terminating with its lower open end exposed at said lower surface, said gate passage means having a restricted portion having a maximum width in at least one dimension of 0.75 inches for said solidification of metal therein.

6. A mold as claimed in claim 5, wherein:

said mold cavity means includes a blind riser between said gate passage means restricted portion and a part cavity.

7. A unitary, rigid, self supporting, gas permeable, low temperature bonded, sand grain mold having peripheral side surfaces extending between vertically spaced upper and lower surfaces with mold cavity means spaced therebetween and a plurality of vertical gate passages with lower open ends spaced from one another exposed at said lower surface, for use in a method of vacuum casting metal, comprising:

submerging said lower surface and said open ends of said gate passages beneath an underlying surface of molten metal while maintaining said upper surface and at least a portion of said side surfaces thereabove;

applying a reduced pressure to the upper surface of said mold to simultaneously fill said gate passages and said mold cavity means with molten metal;

solidifying said molten metal throughout the transverse dimension of at least a portion of said gate passages; and thereafter removing said mold and the submerged open ends of said gate passages from contact with said underlying surface of molten metal before said solidified metal in said gate passage portions remelts due to contact with said underlying surface of molten metal, said mold comprising upper and lower low temperature bonded sand grain mold halves adhesively secured together in a generally horizontal mold parting plane with said upper and lower surfaces generally parallel to and vertically spaced on opposite sides of said mold parting plane mold cavity means extending to said generally horizontal mold parting plane and spaced between said upper and lower surfaces, and a plurality of gate passages extending vertically from said mold cavity means through said lower mold half to said lower mold half lower surface and terminating in a generally horizontal plane with their lower open ends spaced from one another exposed at said lower surface, said gate passages each having restricted portions having a maximum width in at least one dimension of 0.75 inches for said solidification of metal therein.

8. A mold as claimed in claim 7, wherein:

said mold cavity means includes a least one mold cavity, and said gate passages include at least two gate extending vertically from said one mold cavity through said lower mold half.

9. A mold as claimed in claim 7, wherein:

said mold cavity means includes a plurality of mold cavities horizontally spaced from one another, and said gate passages include at least one gate passage extending vertically from each mold cavity through said lower mold half.

10. A mold as claimed in claims 5, 7, 8 or 9, wherein:

said mold halves have a maximum life before failure of less than about thirty seconds in the presence of molten metal at a temperature of greater than 2000 degrees F.

11. A mold as claimed in claims 5, 7, 8 or 9, wherein:

said mold has a peripheral sealing surface extending around the periphery of the upper mold half.

12. A low temperature bonded, sand grain mold comprising a peripheral side surface extending between vertically spaced upper and lower surfaces, with mold cavity means spaced therebetween, said mold being characterized in that, said mold is unitary, rigid, and self supporting said lower mold surface and a portion of said side surface are external, unencumbered by mechanical support, and adapted to be submerged in molten metal to be cast in said mold, said mold comprises upper and lower mold halves adhesively secured together at a generally horizontal mold parting plane with said upper and lower surfaces generally parallel to and vertically spaced on opposite sides of said parting plane;

said mold includes gate passage means extending vertically from said mold cavity means through said lower mold half to said lower mold surface, said gate passage means having at least one dimension small enough to solidify molten metal therein when said lower mold surface and said side surface portion are submerged in a molten metal reservoir, said gate passage means having a restricted portion having a maximum width in at least one dimension of 0.75 inches said mold has an upper peripheral sealing surface adapted to be sealed to a vacuum chamber, whereby, when said mold is sealed to said vacuum chamber, said lower surface and said side surface portion are submerged in a reservoir of molten metal, and said mold cavity means is filled by the application of a vacuum, said metal will solidify in said gate passage means and said mold can be removed from said molten metal before said metal in said gate passage means remelts.

13. A mold as claimed in claim 12 wherein said mold cavity means comprises a plurality of mold cavities horizontally spaced from one another, and said gate passage means comprises at least one gate passage extending vertically from each mold cavity through said lower mold surface.

* * * * *

UNITED STATES PATENT AND TRADEMARK OFFICE

CERTIFICATE OF CORRECTION

PATENT NO. : 4,606,396

DATED : August 19, 1986

INVENTOR(S) : George D. Chandley and Richard L. Sharkey

It is certified that error appears in the above-identified patent and that said Letters Patent are hereby corrected as shown below:

Col. 8, claim 1, line 45, change "lover" to --lower--.

Col. 8, claim 2, line 58, change "dimensions" to --dimension--.

Col. 10, claim 8, line 36, before "extending" insert --passages--.

Signed and Sealed this

Twenty-third Day of December, 1986

*Attest:*

DONALD J. QUIGG

*Attesting Officer* *Commissioner of Patents and Trademarks*